United States Patent [19]

Vola et al.

[11] 4,207,101

[45] Jun. 10, 1980

[54] PROCESS FOR MAGNETICALLY TRANSFERRING A POWDER IMAGE

[75] Inventors: Mathias J. J. M. Vola, Velden; Willem T. Draai, Helden-Panningen, both of Netherlands

[73] Assignee: Océ-van der Grinten N.V., Venlo, Netherlands

[21] Appl. No.: 922,336

[22] Filed: Jul. 6, 1978

[30] Foreign Application Priority Data

Jul. 7, 1977 [NL] Netherlands ..... 7707547

[51] Int. Cl.[2] ..... G03G 13/14

[52] U.S. Cl. ..... 430/126; 346/153; 355/3 TR

[58] Field of Search ..... 355/3 R, 3 TR, 3 DR, 355/133; 427/24; 96/1.4; 346/153, 155

[56] References Cited

U.S. PATENT DOCUMENTS

| | | | |
|---|---|---|---|
| 3,093,039 | 6/1963 | Rheinfrank | 355/16 |
| 3,106,479 | 10/1963 | Evans | 427/18 |
| 3,392,642 | 7/1968 | Germer | 355/3 R |
| 3,781,903 | 12/1973 | Jeffers et al. | 346/74.1 |
| 3,791,843 | 2/1974 | Kohlmannsperger | 427/24 X |
| 3,804,511 | 4/1974 | Rait et al. | 96/1 R X |
| 3,902,421 | 9/1975 | Takahashi | 427/24 X |
| 3,955,530 | 5/1976 | Knechtel | 355/3 TR X |

FOREIGN PATENT DOCUMENTS

| | | | |
|---|---|---|---|
| 1039073 | 9/1958 | Fed. Rep. of Germany | 427/24 |
| 1169510 | 11/1969 | United Kingdom | 355/3 R |

*Primary Examiner*—Fred L. Braun

*Attorney, Agent, or Firm*—Albert C. Johnston

[57] ABSTRACT

Transfer of a powder image from a material carrying the image, such as a photoconductive material utilized for indirect electrophotographic copying, is effected magnetically by employing magnetically attractable developing powder for forming the image and bringing the powder image while under the influence of a magnetic field into contact with a first receiving support that comprises a myriad of zones of a first material which are separated from each other by a second material, one of these materials being magnetizable and the other being not magnetizable. The materials preferably are metals giving the first receiving support a durable smooth surface. The zones of the first material have a diameter and inter-distance of, at most, about 5 times and preferably about 1 to 2 times the diameter of the largest powder particles to be transferred, so usually of about 50 to 100 microns. After being transferred magnetically to the first receiving support the powder image is transferred from it, directly or indirectly, to a final receiving support which usually is plain copy paper.

11 Claims, 1 Drawing Figure

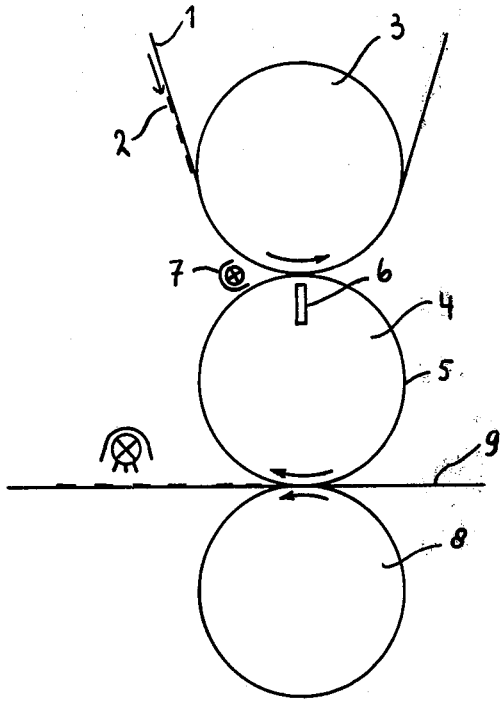
1
2
3
7
6
4
5
9
8

PROCESS FOR MAGNETICALLY TRANSFERRING A POWDER IMAGE

This invention relates to a process for magnetically transferring a powder image formed of permanently magnetizable powder.

In the so-called indirect electrophotographic copying system as it has been practically used, a latent electrostatic image is formed in a photoconductive material and then is developed with a developing powder, after which the resultant powder image is transferred and finally is fixed to a receiving material, commonly of plain paper. After the transfer of the powder image the surface of the photoconductive material is cleaned and used for another copying run.

The transfer of the powder image to the receiving material is usually effected under the influence of an electric field generated between the photoconductive material and the receiving material. Such electrical transfer has a disadvantage in that blurring of the images occurs because of powder particles being dispersed by electric discharges which occur continuously in the transfer zone. A further disadvantage of electrical transfer is that the results obtained with it in regard to the efficiency of transfer and the quality of the transferred image depend on the atmospheric conditions and the electric properties of the developing powder and the receiving material.

In order to enable transfer of a powder image independently of atmospheric conditions and of the electric properties of developing powder and receiving material, it has been proposed to use a magnetically attractable developing powder for the development of the electrostatic image and to transfer the powder image under influence of the magnetic field of a permanent magnet or electromagnet located behind the receiving material. However, image blurring also occurs with this magnetic transfer method, because particles of developing powder move over the receiving material under influence of the magnetic field during delivery of the receiving material out of the transfer zone.

Such blurring of images can be prevented by simultaneously transferring the powder image magnetically and fixing it with the aid of heat, as described in U.S. Pat. Nos. 3,093,039 and 3,106,479. In such processes, however, since the heat-fixation of the powder image is carried out while the image is still in contact with or very near to the photoconductive material, there is danger that melted or softened particles of developing powder may deposit on the photoconductive material and, by adhering permanently, render this material no longer usable. Moreover, a further disadvantage exists in the process of U.S. Pat. No. 3,093,039, in which transfer and fixing of the powder image are effected simultaneously under a high frequency magnetic field, in that a very large amount of energy is required in order to effect the desired fixing of the image. On the other hand, in the process of U.S. Pat. No. 3,106,479, in which a heating element is located in the transfer zone very near to the photoconductive material, the photoconductive material is also heated considerably with the result that its photoelectric properties deteriorate so quickly that only a relatively limited number of copies can be made by its use.

U.S. Pat. No. 3,804,511 describes, with reference to FIG. 8 thereof, a process for the formation of a latent magnetic image from a powder image formed electrophotographically on a photoconductive material with the use of magnetically attractable developing powder. In that process, a uniform layer of permanently magnetizable material magnetized to a fine linear pattern is brought into contact with the image-carrying surface of the photoconductive material, and by the action of a magnetic erasing head located behind the photoconductive material the magnetized layer is demagnetized in the areas that are not shielded by image areas of the powder image. A latent magnetic image is thus formed in the magnetized layer. During its formation a part of the magnetically attractable developing powder is transferred to this magnetic image. However, only a small quantity of developing powder is transferred, so that, without more, the process described is not useful for image transfer in an indirect electrophotographic copying system. The process also has a further handicap in that a wide magnetic head is required for magnetizing the permanently magnetizable layer, which head must be manufactured with great precision in order to provide a magnetic field of uniform strength over its full working width.

The present invention provides an improved process for transferring a powder image formed of magnetically attractable powder, by which process a high transfer efficiency is achieved and sharp images are obtained without need for fixing the powder image on the receiving support simultaneously with the magnetic transfer. Thus, the present process overcomes the disadvantages of the magnetic transfer processes mentioned above, including those of the processes described in U.S. Pat. Nos. 3,093,039 and 3,106,479.

According to this invention, the powder image is transferred under the influence of a magnetic field to a first receiving support from which the image is subsequently transferred directly of indirectly to a final receiving support, and the first receiving support comprises a myriad of zones of a first material which are separated from each other by a second material, one of these materials being magnetizable and the other of them being not magnetizable. A magnetizable material as meant herein is a ferro-magnetic or ferri-magnetic material or a material which contains ferro-magnetic or ferrimagnetic material in finely dispersed condition.

The form of the zones of the first material in the first receiving support, which are separated from each other by a second material, can be chosen arbitrarily, but for practical reasons a substantially square or round form of these zones is preferred. In order to obtain good sharpness of the powder images transferred to the first receiving support, and also for achieving a high resolving power, the zones of the first material should be small. Good results are obtained when the greatest diameter of the zones composed of the first material, as well as the inter-distance between them, lies between the diameter of the smallest developing powder particles to be transferred and five (5) times the diameter of the largest powder particles to be transferred. Preferably, that greatest diameter as well as the greatest inter-distance between the zones of the first material amounts to one or two times the diameter of the largest developing powder particles. Since the developing powders commonly used in electrophotographic copying processes usually have particle sizes in the range of 5 to 50 micrometers, the greatest diameter of the zones of the first material and the greatest inter-distance between these zones will usually amount to between 5 and 250 micrometers, and preferably to about 50 to 100 micrometers. For obtaining a good image quality, the zones of the first material should be distributed quite uniformly over the surface of the first receiving support. Preferably about 30 to 70% of the surface of the first receiving support is covered by these zones.

The magnetizable material of the first receiving support may be any of the known permanently or non-permanently magnetizable materials. Examples of magnetizable materials are: iron, cobalt, nickel; ferrites; alloys of Co and Ni, of Cu, Ni and Fe, and of Cu, Ni and Co; chromium dioxide; γ-ferric oxide; and, further, the materials mentioned in Dutch patent application 6806473. The magnetizable material may be present in the magnetizable regions on the first receiving support in the form of a continuous layer or as a dispersion of finely divided magnetizable particles in a film forming binder.

The non-magnetizable material of the first receiving support consists, for instance, of a metal such as copper or aluminum, of glass, or of a plastic, in which non-magnetizable substances such as fillers or antistatic agents may be present.

First receiving supports made with a smooth and relatively hard surface are preferred for use in the present process because, by virtue of their greater mechanical strength, such receiving supports have a longer duration of service life than receiving supports having a more or less rough and/or soft surface. Therefore, first receiving supports having a smooth metallic surface, in which the first material and the second material each consists of metal or a metal alloy, are preferably employed.

The first receiving support for use in this process can be manufactured in various ways. A photomechanical manufacturing method is very suitable, according to which a layer of magnetizable or non-magnetizable material applied onto a non-magnetizable support is coated with a layer of a lacquer that can be cross linked by light, and this lacquer layer is exposed under a suitable screen pattern, for instance a crossline screen or autotype screen as used in the graphic arts, after which the unexposed parts of the lacquer layer are removed. The uncovered parts of the underlayer are then removed by treatment with a suitable solvent or an etching liquid, and subsequently a layer of non-magnetizable material or magnetizable material, depending upon the material of the underlayer, is applied to the recessed areas. Finally, the exposed parts of the lacquer layer are also removed and the surface of the receiving support thus obtained is preferably made smooth by a suitable treatment, for instance by polishing. Instead of using a non-magnetizable support provided with a non-magnetizable layer, use can be made of a self-supporting non-magnetizable material, for instance a copper or aluminium plate, belt or cylinder, or a glass plate or cylinder.

The light-sensitive layer of lacquer applied over the magnetizable or non-magnetizable layer may be, for instance, a layer of photopolymer such as described in U.S. Pat. Nos. 2,732,301, 3,357,831 and 3,506,440, British Patent Specifications Nos. 1,065,665 and 1,128,850, French Pat. No. 1,528,490 and Dutch patent applications Nos. 6702407 and 6703214.

The application of the non-magnetizable or magnetizable material onto the locations where the underlayer has been removed may be effected by a conventional method. When the material is a metal, it can be applied, for instance, electrolytically or by a catalytic chemical process or by vapor-coating. A non-metallic material, for instance a plastic or a plastic in which magnetizable material has been finely dispersed, can be applied by applying a solution or dispersion of the material and then drying the layer formed, and hardening it if necessary, at elevated temperature.

In another method, which differs from the photomechanical method, a first receiving support suitable for use according to the invention can be obtained by pressing a relief into a surface of a plastic film, or of a plastic layer, held on a suitable non-magnetizable support, if so desired after the surface of the plastic film or the plastic layer has been softened with a suitable swelling agent, and subsequently filling up the recesses or deepened parts formed by the relief with a magnetizable material, for instance, a fine dispersion of magnetizable pigment in a film-forming binder.

A suitable first receiving support can also be made by coating a non-magnetizable support with a dispersion of granulated magnetizable particles having sizes between 5 and 250 micrometers in a solution of a film-forming binder, in this way forming a layer that contains separate magnetizable particles separated from each other by non-magnetizable material, i.e., by the binder. The dispersion so used can also contain non-magnetizable pigment particles, in which case the magnetizable granules are separated from each other by the binder and by non-magnetizable pigment.

In the use according to the invention of a first receiving support in which one material of the first and second materials is permanently magnetizable, the transfer of a magnetically attractable powder image is effected by magnetizing the magnetizable material of the first receiving support and then bringing the resulting locally magnetized receiving support into contact with the powder image. The magnetizing of the zones of magnetizable material can be effected simply by passing the first receiving support through a homogeneous magnetic field of sufficient strength. In order to assure substantially complete transfer of the powder image to the first receiving support, the magnetizable zones should have a remanence of at least 2 kA/m. A good transfer efficiency can be further assured by the action of an auxiliary magnetic field generated in the transfer zone, for instance, by installing a magnet behind the first receiving support in the transfer zone or by installing two unlike magnet poles opposite to each other behind the first receiving support and the support that carries the powder image to be transferred.

When the process of the invention is used for the transfer of powder images formed of permanently magnetizable developing powder, the magnetizable material of the first receiving support can be material that is not permanently magnetizable. In such cases, the transfer of the powder images to the first receiving support is effected by magnetizing the powder images and subsequently bringing them into contact with the first receiving support, or by bringing the first receiving support into contact with the powder image and simultaneously generating in the contact zone a magnetic field strong enough to magnetize the developing powder. Upon subsequently separating the first receiving support from the original image support, the magnetic powder of the image is kept in adherence to the magnetizable material of the first receiving support by the influence of the permanently magnetized powder particles.

After the powder image is transferred to the first receiving support, the image is transferred from this support in a known way, directly or indirectly, to the final receiving support, which ordinarily will consist of plain paper. Direct transfer of the powder image to the final receiving support can be effected, for instance, by a process similar to that described in U.S. Pat. No. 3,804,511, in which the final receiving support is pressed against the powder image so as to cause transfer of the image as a result of the pressure, after which the image is fixed suitably on the final receiving support, for instance by heating it. Indirect transfer of the powder image to the final receiving support can be effected, for instance, in a manner similar to that described in British Pat. No. 1,245,426, in which the powder image is transferred under pressure to a resilient medium and subsequently is transferred from the resilient medium to the final receiving support, and is fixed at the same time, under pressure and heat.

The present process is especially attractive for use in indirect electrophotographic copying systems in which a magnetically attractable developing powder, electrically conductive or non-conductive, is used for the development of the electrostatic image. For this use, in comparison with known processes, the present process has a great advantage in that good transfer of the powder image is obtained under conditions that are quite favorable for prolonged service life of the photoconductive medium, which is usually quite vulnerable to deterioration. Because of the fact that no heat needs be supplied to the powder image to be transferred, thermal change of the photoconductive medium is prevented; and since only a slight contact pressure is required between the photoconductive medium and the first receiving support, mechanical stresses and consequent changes of the photoconductive surface are limited to a minimum. In the latter respect the present process differs advantageously from the process described in British Patent Specification No. 1,245,426.

When employing the present process in indirect electrophotographic copying systems, the transfer efficiency can be increased even more by exposing the photoconductive medium, before or during the transfer, so as to eliminate the electrostatic force of attraction acting on the particles of developing powder.

The powder images to be transferred according to the invention can be formed of known magnetically attractable developing powders which may be either electrically conductive or non-conductive. Among the suitable developing powders are, for instance, those described in German patent application No. 1,937,651, Dutch patent application No. 7203523 and U.S. Pat. No. 3,093,039.

The single FIGURE of the accompanying drawing schematically illustrates an arrangement of apparatus suitable for carrying out the process of the present invention.

The invention will be further understood from the following illustrative examples.

EXAMPLE 1

A photoconductive belt made as described in the example of British Patent Specification No. 1,408,252 was provided with a latent charge image by successively electrostatically charging and imagewise exposing the photoconductive surface of the belt. This charge image was developed by a known magnetic brush method, with a magnetically attractable, one-component developing powder the particles of which had sizes between 10 and 30 micrometers and a specific resistance of $8\times10^8$ ohm.cm. The developing powder was prepared by the method described in Example 3 of pending U.S. patent application Ser. No. 780,431 filed Mar. 23, 1977.

The powder image thus formed on the photoconductive belt was transferred to a receiving paper, according to the process of the present invention, by conveying the photoconductive belt through a transfer device having the arrangement schematically illustrated in the accompanying drawing.

In the illustrated transfer device, a photoconductive belt 1 carrying a powder image 2 to be transferred is transported over a supporting roller 3 and, with slight contact pressure, is brought into contact with an image receiving roller 4 which comprises a sleeve 5 formed with a myriad of permanently magnetizable zones separated from each other by non-magnetizable material. The supporting roller 3 and the sleeve 5 are driven in the direction indicated by the arrows. A stationary bar magnet 6 extending in axial direction inside the rotating sleeve 5 is arranged in such manner that the field of this magnet is effective only in the nip between the roller 3 and the sleeve 5. The magnetic field generated in the nip by the magnet 6 has for example, a strength of about 24 kA/m.

During the first revolution of the sleeve 5, the magnet 6 effects a permanent magnetization of the magnetizable zones on the sleeve. The magnet serves subsequently as an auxiliary magnet aiding transfer of the powder image to the magnetized zones. For further improving the transfer efficiency, a lamp 7 directs light onto the belt 1 at a location just ahead of the nip between the roller 3 and the sleeve 5, which light exposes away the charge image still present on the photoconductive belt.

The powder image transferred to the sleeve 5 is carried on this sleeve into the nip between the sleeve 5 and an elastic pressure roller 8, where the image is transferred under pressure to a sheet 9 of receiving paper supplied from a stock pile. Finally the powder image is fixed on the receiving paper by heat.

The sleeve 5 formed with permanently magnetizable zones separated from each other by non-magnetizable material was made by a photomechanical process, as follows:

A copper sleeve was coated with a positively working light-sensitive layer of lacquer (photoresist PK 13 of Kalle A.G., Wiesbaden, West Germany) and the lacquer layer was exposed to light under a 54 points screen, after which the exposed parts of the lacquer layer were removed. The areas of the copper sleeve so uncovered were subsequently etched to a depth of about 3 micrometers by a conventional etching liquid based on ferric-chloride and hydrochloric acid. The etched areas of the sleeve were subsequently filled up electrolytically with a permanently magnetizable Co-Ni alloy. Finally the unexposed parts of the lacquer layer were removed and the surface of the sleeve was made smooth by polishing. The sleeve thus obtained carried at its surface fine, point-like zones of copper, which were separated from each other by permanently magnetizable zones of Co-Ni alloy.

The transfer method described above resulted in sharp copies of very good quality, with which a resolving power of more than 5 pairs of lines per mm was attained. The efficiency of the transfer of the powder image to the first receiving support was equivalent to the efficiency achieved with conventional electrical transfer methods.

Equally good results were obtained when, instead of a sleeve having permanently magnetizable zones of Co-Ni alloy, a similar sleeve was used of which the magnetizable zones consisted of a fine dispersion of permanently magnetizable chromium dioxide particles in epoxy resin at a volume ratio of 1:1.

EXAMPLE 2

The process of Example 1 was repeated, but now a permanently magnetizable, one-component developing powder was used for the development of the electrostatic image, which powder consisted of thermoplastic particles that contained 40% by weight of epoxy resin and 60% by weight of permanently magnetizable $\gamma$-ferric oxide (Bayer magnetic pigment AC 5062) and carried a layer of electrically conductive carbon at their surface. The specific resistance of the developing powder amounted to $3\times10^8$ ohm.cm, while the particle sizes were between 10 and 30 micrometers.

A sleeve similar to that employed in Example 1 was used as the first receiving support, but in this example the sleeve carried non-permanently magnetizable zones of nickel instead of permanently magnetizable zones of Co-Ni alloy.

Copies of very good quality were also obtained in this way, and the transfer efficiency in the first transfer step was again substantially equal to that obtained by the usual electrical transfer methods.

What is claimed is:

1. In a process for transferring a powder image formed of magnetically attractable developing powder, in which the powder image under influence of a magnetic field is transferred magnetically to a first receiving support and is subsequently transferred directly or indirectly from said first receiving support to a final receiving support, the improvement comprising that the first receiving support comprises a myriad of zones of a first material separated from each other by a second material, one of the said materials being magnetizable and the other of them being not magnetizable.

2. A process according to claim 1, said zones having a substantially square or round shape.

3. A process according to claim 1 or 2, the greatest diameter of said zones and also the greatest inter-distance between them lying between the diameter of the smallest powder particles of the powder image and at most five times the diameter of the largest powder particles thereof.

4. A process according to claim 1 or 2, the greatest diameter of said zones and also the greatest inter-distance between them amounting to about 50 to 100 micrometers.

5. A process according to claim 1 or 2, said zones collectively covering 30–70% of the surface area of the first receiving support.

6. A process according to claim 1 or 2, each of the said materials being a metal or a metal alloy, and said materials together providing said first receiving support with a smooth, metallic surface.

7. A process according to claim 1 or 2, said one material being a permanently magnetizable material having a remanent magnetism of at least 2 kA/m.

8. In a process for transferring a powder image formed of magnetically attractable developing powder, in which the powder image under influence of a magnetic field is transferred magnetically to a first receiving support and is subsequently transferred directly or indirectly from said first receiving support to a final receiving support, the improvement comprising that said first receiving support has a smooth metallic surface formed by a myriad of zones of magnetizable metal or metal alloy separated from each other by non-magnetizable metal or metal alloy, said zones having a substantially square or round shape and occupying 30 to 70% of the area of said surface and their greatest diameter and the greatest distance between them amounting to between 5 and 250 microns.

9. A process according to claim 8, said zones being formed of permanently magnetizable metal or alloy having a remanent magnetism of at least 2 kA/m, and transfer of the powder image to said first receiving support being effected by contacting the latter with the powder image under slight contact pressure.

10. A process according to claim 8, said powder image being formed of permanently magnetizable powder particles and said zones being formed of non-permanently magnetizable metal or metal alloy, and transfer of the powder image to said first receiving support being effected by contacting the latter with the powder image under slight contact pressure with said image in magnetized state.

11. In an electrophotographic process in which a latent electrostatic image is formed in a photoconductive material, the latent image is developed with a magnetically attractable developing powder and the resultant powder image under influence of a magnetic field is transferred magnetically from the photoconductive material to a receiving support, the improvement comprising that the magnetic transfer of the powder image is effected by a process according to claim 1, claim 9, or claim 10.

* * * * *